US005315565A

United States Patent [19]

Brosow

[11] Patent Number: 5,315,565

[45] Date of Patent: May 24, 1994

[54] RESONANCE OSCILLATOR

[76] Inventor: Jörgen Brosow, Plainfeld 156, A-5322 Hof, Austria

[21] Appl. No.: 853,760

[22] PCT Filed: Nov. 9, 1990

[86] PCT No.: PCT/EP90/01882

§ 371 Date: Jun. 1, 1992

§ 102(e) Date: Jun. 1, 1992

[87] PCT Pub. No.: WO91/07741

PCT Pub. Date: May 30, 1991

[30] Foreign Application Priority Data

Nov. 9, 1989 [DE] Fed. Rep. of Germany ..... 3937365
Jun. 29, 1990 [DE] Fed. Rep. of Germany ..... 4020881

[51] Int. Cl.[5] ..... H04R 17/00

[52] U.S. Cl. ..... 367/140; 367/162; 367/176; 310/334

[58] Field of Search ..... 367/140, 162, 176; 310/334, 322

[56] References Cited

U.S. PATENT DOCUMENTS 852,647 5/1907 Blake ..... 367/176
2,490,452 12/1949 Mason ..... 367/140
3,219,970 11/1965 Sims ..... 367/176
3,743,446 7/1973 Mandroian ..... 367/162
4,671,379 6/1987 Kennedy et al. ..... 181/106

FOREIGN PATENT DOCUMENTS 374934 6/1907 France .
1553058 11/1967 France .

*Primary Examiner*—J. Woodrow Eldred
*Attorney, Agent, or Firm*—Herbert Dubno

[57] ABSTRACT

A resonance oscillator comprises an active, e.g. disk-shaped, oscillator part (2) which is brought into contact, forming a couple oscillator, with a passive, comparatively longer oscillator part. This oscillator part, which basically determines the resonant frequency, consists of a variable-length solid column or liquid column (11) the length of which can be varied continuously in the direction of the sound vector in order to change the resonant frequency. The active oscillator part (2) is mounted on the base of an elongated resonance container (6) which contains the liquid that forms the liquid column (11). The length of the liquid column is varied by sliding a piston (5). The resonance container (6) is bounded by a corrosion-resistant, high-strength covering disk (7) of minimal thickness and is connected to an equalizing container (9) which receives the liquid displaced by the piston from the resonance container and returns the liquid to the resonance container.

16 Claims, 2 Drawing Sheets

RESONANCE OSCILLATOR

CROSS REFERENCE TO RELATED APPLICATIONS

This application is a national phase of PCT/EP90/01882 filed Nov. 9, 1990 and based, in turn, upon national applications P 39 37 365.7 filed Nov. 9, 1989 and P 40 20 881.8 filed Jun. 29, 1990 under the International Convention.

FIELD OF THE INVENTION

The invention relates to a resonance oscillator including an active oscillator part which is in contact with a passive, comparatively longer oscillator part, thereby forming a couple oscillator, the passive oscillator part basically determining the resonant frequency and being formed by a liquid column contained in a resonance container or by a solid column the length of which can be varied continuously by means of a movable part in order to change the resonant frequency, the resonance container communicating with an equalizing container which receives and returns, respectively, the liquid being displaced from and drawn into the resonance container, respectively when the movable part is moved.

BACKGROUND OF THE INVENTION

A resonance oscillator of this type is already known from FR-A-374 934. The known resonance oscillator is designed for operations in sea water. As the resonant chamber, it has a cylindrical body which is open on one end and is connected with the surrounding region via openings formed in its holder. The resonant chamber is not filled with a sealed-off liquid volume. Rather, it is filled with the same liquid that is to be sounded. Further, this prior art reference discloses as an acoustic pick-up a cylindrical part attached inside onto the ship's wall, the base thereof, via an outside thread provided at the base, being screwable to an inside thread of the cylindrical pick-up. Also in this case, the resonant chamber is connected with the ambient sea water through an opening in the ship's wall and does not form a sealed-off liquid volume. Thus, in the prior art the density values of sea water and the sound velocity in sea water are effects which have to be accepted from the beginning. Moreover, resonance adaptation takes place only on the side of the receiver while on the side of the transmitter no change in the length of the resonant chamber is provided at all. The application range therefore is restricted.

OBJECT OF THE INVENTION

The object of the invention is to provide a transmitter having a resonance oscillator of the type mentioned initially a whose resonant frequency can be varied continuously and with a high effectiveness of the resonance oscillator.

SUMMARY OF THE INVENTION

The resonance oscillator according to the invention by which this object is achieved comprises a part for setting the resonant frequency in the form of a piston sliding axially in the resonance container, the equalizing container being sealed with respect to the surrounding region by means of a counterpressure diaphragm which enables a change in volume corresponding to the axial displacement of the piston.

As a consequence, in this case the resonance container and the equalizing container form a sealed-off liquid volume. Thereby the filler liquid can be selected freely and independently of the liquid conveying the sound. For example, the liquid column in this structure may be formed by a liquid of a highest possible density, a highest possible sound velocity and a highest possible characteristic acoustic impedance (the product of density and sound velocity). An example therefor is a silocone oil filling. Silicone oil has a low sound absorption coefficient so that the losses in the filler liquid are small. Also, a great latitude for the adaptation to the sound-wave length is obtained.

For this purpose, an axially sliding piston is provided in the resonance container, which makes the adjustability particularly simple. Since, however, the liquid volume in the resonance container and the equalizing container is a fixed volume, additional arrangements for the free sliding movement of the piston have to be made. This is effected with the aid of the counterpressure diaphragm which seals the equalizing container on the side that faces away from the liquid container.

The equalizing container may be a separate container positioned beside the liquid container. However, it may also be formed in the cylinder wherein the piston is guided, too, on the back of the latter. For this purpose, a gap is left between the piston and the cylinder wall of the resonance container. In the case of a cylindrical equalizing container that is arranged laterally beside the cylindrical resonance container and is provided with a counterpressure diaphragm, the couple liquid forming the passive oscillator part is always under pressure, namely under the pressure prevailing outside the counterpressure diaphragm. Further, in this way the required force-locking connection between the active oscillator part, namely the transducer element (PZT), and the liquid forming the passive oscillator part is guaranteed. Also, the threshold value at which cavitation appears is raised.

A particularly advantageous construction is obtained when the resonance container and/or the equalizing container are of cylindrical shape.

A particularly simple resonance container with no operational problems arising is obtained in that the piston can slide axially in a cylinder wherein it separates the resonance container located at its face from the equalizing container located at its back, in that the connection between the resonance container and the equalizing container is provided in the region of the piston, and in that the active oscillator part abuts against the covering plate by which the resonance container is bounded at its end being located at a greater distance from the piston.

BRIEF DESCRIPTION OF THE DRAWINGS

Additional details, advantages and features of the invention will be apparent from the following description and the drawing, all details of the drawing not described in the text being expressly incorporated herein by reference for purposes of disclosure. In the drawing.

SPECIFIC DESCRIPTION

Figure 1:
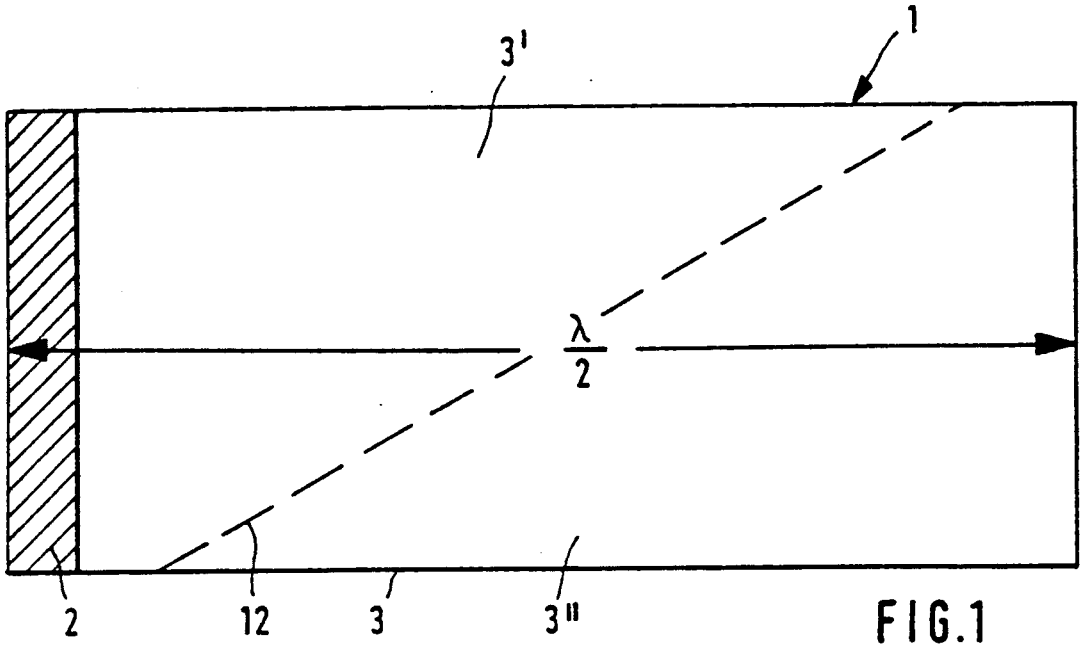
FIG. 1 is a schematic view of a resonance oscillator in the form of a couple oscillator, consisting of a relatively thin active oscillator part and a passive, comparatively longer oscillator part being formed by a solid column.

As shown in the drawing, the resonance oscillator in the form of a couple oscillator as illustrated in FIG. 1 comprises an active disk-shaped oscillator part 2, namely a PZT transducer element, and a passive oscillator part 3 in the form of a solid body. The resonant frequency of said couple oscillator decisively depends on the sound velocity v of the material of which the passive oscillator part 3 is made. The resonant frequency can be derived practically alone from the length of the passive oscillator part 3 with sufficient accuracy only if the thickness of the disk-shaped oscillator part 2 is very small relative to the length of the passive oscillator part 3. When the thickness of the disk reaches approximately the order of magnitude of the thickness of the solid body, the value v needs to be corrected to allow calculation of a mean value of the velocity v. As shown, the length of the solid body which forms the passive oscillator part 3 corresponds to half the wavelength, i.e. $\lambda/2$.

Figure 2:
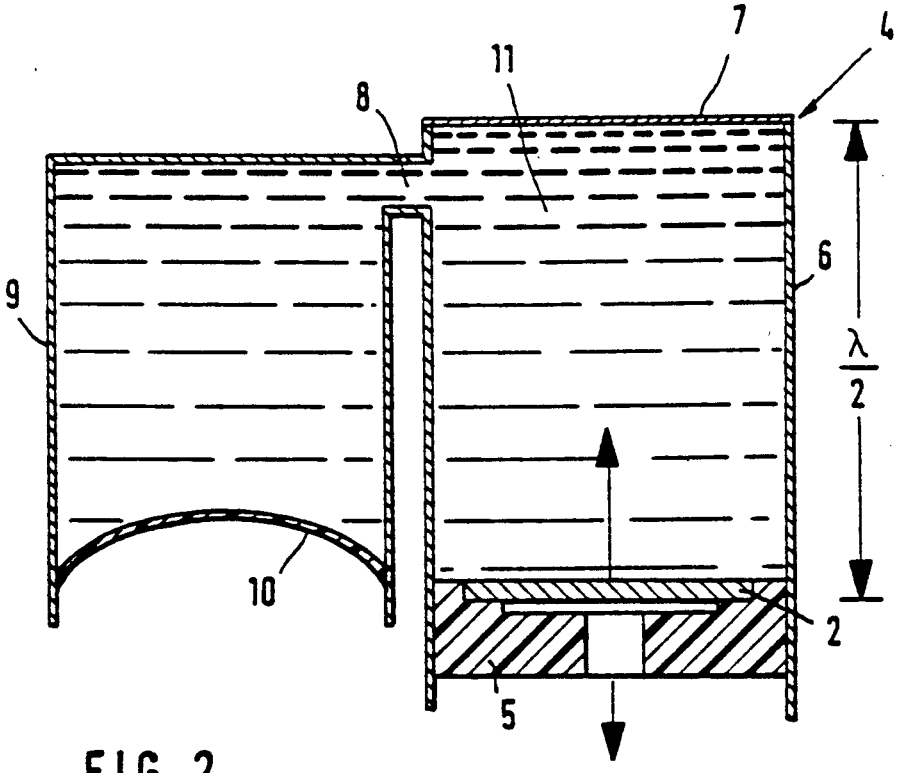
FIG. 2 is a schematic sectional view of the resonance oscillator of the invention the resonant frequency of which can be varied by changing the length of a liquid column.

FIG. 2 shows a resonance oscillator in the form of a couple oscillator 4 according to the invention, wherein the active oscillator part 2 is embedded in a piston 5 which is made of insulating material having favorable HF characteristics. The piston 5, which may for example be produced of Teflon, is mounted within an elongated container so that it can slide. The elongated container preferably has the shape of a cylinder whose base is formed by the piston. In this structure the piston 5 defines the resonance container 6. The resonance container 6 on the side opposite the active oscillator part 2 has a high-strength corrosion-resisting covering plate 7 of a small thickness that should be smaller than one-hundredth of the largest sound-wave length. Preferably, the material used for this covering plate 7 is titanium.

The resonance container 6 communicates, via a lateral container opening 8, with an equalizing container 9 which, too, is preferably of cylindrical shape. Said container opening 8 is located in the region of the end of the resonance container 6 that is at a greater distance from the active oscillator part 2. For closure of the equalizing container 9, the latter is provided with a counterpressure diaphragm 10 which is located at the end of the counter-pressure container 9 that is at a greater distance from the lateral container opening 8. In the resonance container 6 is contained a liquid forming a liquid column 11 which extends from the active oscillator part 2 to the covering plate 7. The length of this liquid column 11 can be varied by axially sliding the piston 5 which forms the base. When the length of the column is reduced, some of the liquid flows out of the resonant container 6 through the container opening 8, and flows into the equalizing container 9 and, in case of a length increase, reversely flows back from the latter into the resonant container. During this process, the counter-pressure diaphragm 10 over which the pressure outside the resonance container 6 acts upon the liquid column 11 contained in the reconant container and forming the passive oscillator part becomes deformed.

The liquid includes any substances that are capable of flowing in the broadest sense, irrespective of whether they are of inorganic or organic origin or even of metallic nature as, for example, mercury. What is essential merely is that the characteristic acoustic impedance $\rho \cdot v$ of the liquid differs from that of the medium outside the resonance container 6. Further, it is necessary for the liquid to ensure a greatest possible sound velocity v so that a sufficiently large range of length variation is available. Finally, the sound absorption coefficient is required to be low.

The following table shows the characteristic values of the density $\rho$, of the velocity v, and of the acoustic impedance $\rho \cdot v$:

| | $\rho$ [$10^3$ kg · m$^{-3}$] | v [m · s$^{-1}$] | $\rho \cdot v$ [$10^6$ kg · m$^{-2}$ · s$^{-1}$] |
|---|---|---|---|
| liquids | | | |
| water 20° C. | 1.00 | 1,480 | 1.48 |
| acetylenetetrabromide | 2.963 | 1,041 | 3.08 |
| ethylenebromide | 2.056 | 1,009 | 2.07 |
| bromonaphtalene | 1.487 | 1,372 | 2.07 |
| bromal | 2.550 | 966 | 2.46 |
| glycerol | 1.261 | 1,923 | 2.42 |
| nitroethylalcohol | 1.296 | 1,578 | 2.04 |
| mercury | 13.595 | 1,451 | 19.72 |
| tetrabromoethane | 2.963 | 1,041 | 3.08 |
| trimethylenebromide | 1.977 | 1,144 | 2.26 |
| solids: | | | |
| aluminum | 2.7 | 6,300 | 17.00 |
| special steel | 7.8 | 6,010 | 47.00 |
| PZT ceramics | 7.8 | approx. 4,700 | 36.70 |

All of the above values apply to room temperature. Due to the relation $\lambda = v/f$, with $l = \lambda/2$, in case of $f = 30$ kHz the length of the passive oscillator part when using glycerol is as follows:

$$\lambda = \frac{192{,}300}{30{,}000}\ \text{cm} = 6.41,$$

and $$l = \lambda/2 = 3.2\ cm$$

There is an upper frequency limit due to the length of the passive oscillator part. However, oscillator parts of a length corresponding to a multiple of $\lambda/2$ are also possible.

The resonant body according to the invention can be successfully used not only as an ultrasonic transmitter of selected frequencies, but also as an ultrasonic scanner within the resonant range, i.e. with a narrow band width, for example for locating environmental pollution in sea water and rivers, for locating shoals of fish by making use of the fact that they emit frequencies that are characteristic of them, and for navigation purposes.

In the foregoing the invention has been described by making reference to a resonant body including a liquid column 11 of variable length as illustrated in FIG. 2. On the other hand, it is also possible to replace the liquid column 11 and successfully employ a solid column 3 of variable length. To this end, the column needs to be in two-part form. The way in which the column is separated into the two parts 3', 3'' is indicated schematically by the broken line 12 in FIG. 1. Each of the two parts has a face-ground contact surface running along the broken line 12. The contact surface plane of both column parts 3', 3'' makes an acute angle of the same size with the column axis of the solid column 3. The length of the solid column, i.e. the distance between the column surface extending perpendicularly to the column axis and being in contact with the active oscillator part 2 and the practically parallel extending column surface of the other column part 3'' abutting against the first column part 3, can be varied by shifting the two column parts along their contact surfaces.

Figure 3:
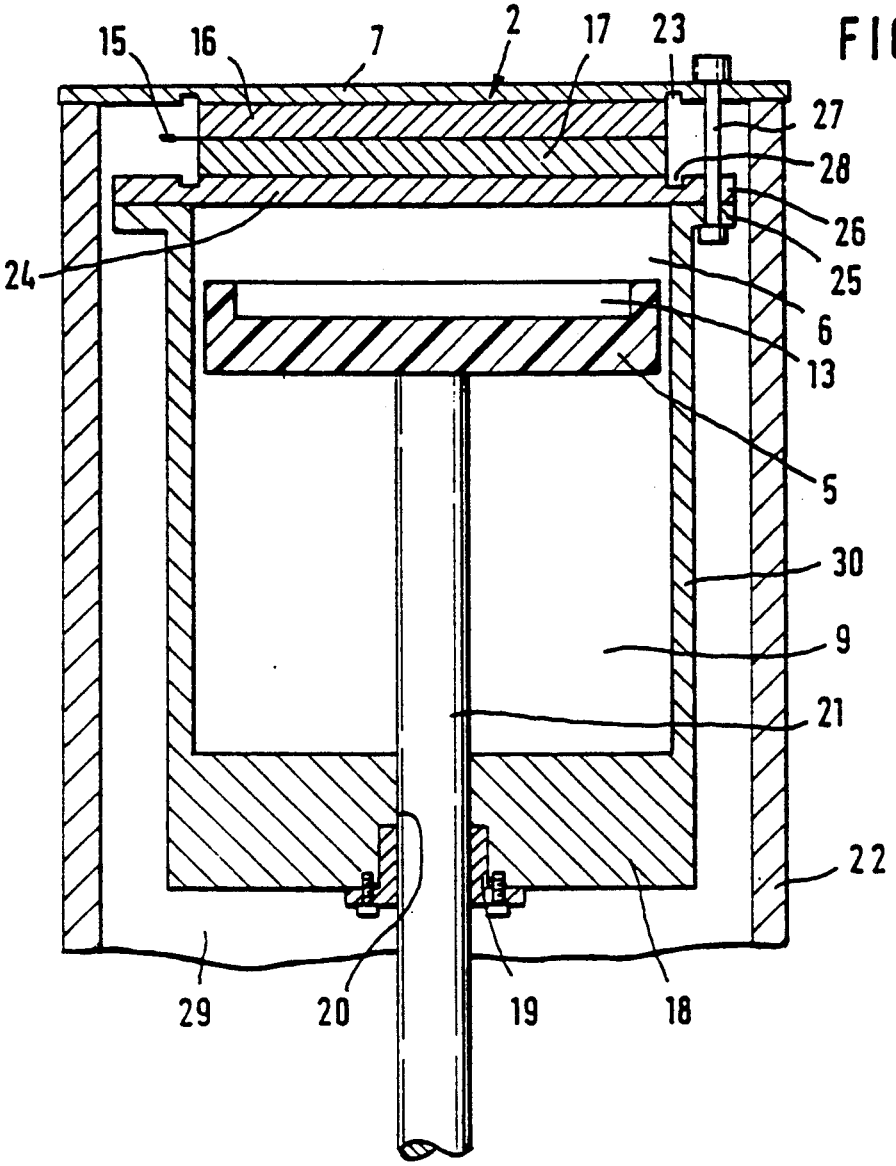
FIG. 3 shows a section through a modified embodiment of the inventive resonance oscillator.
Figure 4:
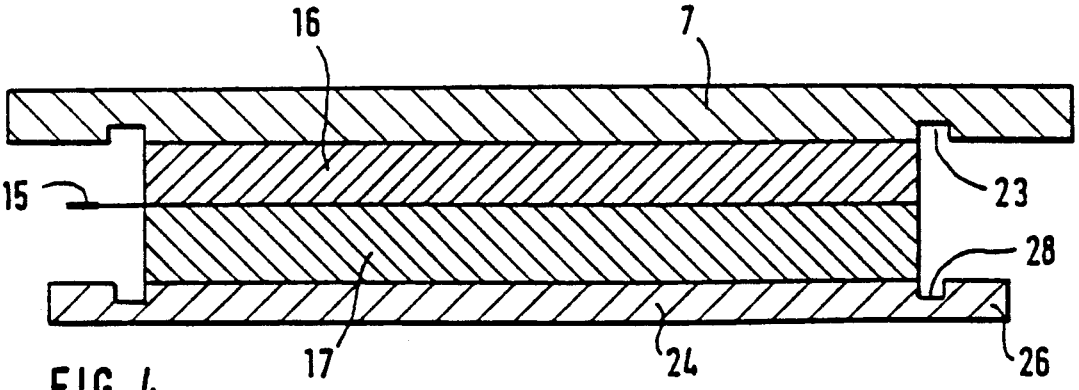
FIG. 4 shows a section through a detail of the resonance oscillator of FIG. 3.

FIGS. 3 and 4 show a modified embodiment of the resonance oscillator of FIG. 2. Unlike the embodiment of FIG. 2, in this modification the piston 5, which slides axially in a cylinder 30, separates the actual resonance container 6 located at its front from the equalizing container 9 located at its back. The equalizing container 9 here replaces the laterally connected but separate equalizing container of the first embodiment. The connection between the resonance container 6 and the equalizing container 9 is provided in the region of the piston 5. As shown in FIG. 3, in this embodiment the piston 5 is spaced apart from the cylinder wall, creating thus the connection between the resonance container 6 and the equalizing container 9. Besides, in this embodiment the active oscillator part abuts against the corrosion-resisting covering plate 7 by which the resonance container 6 is bounded on its end being located at a greater distance from the piston 5. The piston 5 has a chamber 13 on its face, which chamber is sealed with respect to the resonance container 6 by means of a covering foil 14. This covering foil 14 is a metallic foil preferably made of titanium.

FIG. 4 shows that the active oscillator part 2 in the form of a couple oscillator consists of two oscillator disks 16, 17 of piezoelectrically active material whose alive "hot" sides abut against one another in opposite directions via a common contact 15. As further shown in FIG. 3, the cylinder 30 which accommodates the piston 5 has a bore hole 20 in the region of its base 18, which bore hole is provided with a packing sleeve 19 and through which bore hole the piston rod 21 passes. The unit consisting of the piston, the cylinder and the oscillator part is mounted in a housing 22 which is sealed with respect to the outside. In this structure, the active oscillator part 2 is suspended over the abutting covering disk 7 so that it is damped with respect to the housing 22 in order to suppress vibration transmission. For that purpose, a rubber disk may be interposed. In the embodiment of FIG. 3, instead of this a first decoupling groove 23 is formed between the housing 22 and the unit consisting of the piston, the cylinder and the oscillator part.

FIGS. 3 4 show that the active oscillator part 2, over the negative, "cold" sides of the two oscillator disks 16, 17, is held in fixed abutment against the covering disk by means of an electrically conductive holding disk 24 corresponding functionally to the electrically conductive covering disk 7. For this purpose, the holding disk 24 has a diameter that is larger than the diameter of the disk-shaped active oscillator part in the form of the two oscillator disks 16, 17. The cylinder 30 is provided with a flange 25 the diameter of which projects over the diameter of the cylinder 30 and corresponds to the diameter of the holding disk 24. The flange 25 of the cylinder 30, together with the abutting rim 26 of the holding disk 24, is fixedly connected to the housing 22. For this purpose, the flange 25 of the cylinder 30 and the rim 26 of the holding disk 24 are penetrated by a plurality of screw bolts 27 which pass through bore holes in the region of the rim of the covering disk 7. Apart from the first decoupling groove 23 between the covering disk 7 and the covering disk rim, a second decoupling groove 28 is formed between the holding disk 24 and the holding disk edge 26 through which the screw bolts 27 penetrate.

FIG. 3 shows that the piston rod 21 extends into the space 29 between the cylinder 30 and the housing 22. In this space 29 is mounted a drive mechanism not shown in the drawing, with which the piston rod 21 is coupled. The position of the piston 5, and thus the resonant frequency, can be freely selected as desired over the piston rod 21 by remote control of the drive mechanism. In said room 29, protected with respect to the outside, is also contained the entire electronic system for the operation of the resonance oscillator, and the contact 15 of the compound oscillator is connected to said electronic system via a cable which is not shown in the drawing.

I claim:

1. A resonance oscillator, comprising:

an active oscillator part;

a passive oscillator part for basically determining a resonant frequency, said passive oscillator part being connected to said active oscillator part and having a resonance container receiving a liquid column of a variable length greater than a length of said active oscillator part;

an equalizing container connected to said resonance container for receiving liquid from and returning liquid to said resonance container;

a piston sliding axially in said resonance container for displacing liquid from said resonance container into said equalizing container and for drawing liquid from said equalizing container into said resonance container, thereby varying the length of the liquid column in said resonance container and setting the resonant frequency; and a counterpressure diaphragm sealing said equalizing chamber with respect to the surroundings of said resonance oscillator and enabling a change in volume within said equalizing chamber corresponding to axial displacement of said piston.

2. The resonance oscillator defined in claim 1 wherein the resonance container communicates via a lateral container opening with the equalizing container.

3. The resonance oscillator defined in claim 2 wherein the lateral container opening is formed in a region of an end of the resonance container located remote from the active oscillator part.

4. The resonance oscillator defined in claim 2 wherein the counterpressure diaphragm is provided on an end of the equalizing container located remote from the lateral container opening.

5. The resonance oscillator defined in claim 1 wherein the piston can slide axially in a cylinder wherein it separates the resonance container located at a front face of the piston from the equalizing container located at a back of the piston, the connection between the resonance container and the equalizing container being provided in the region of the piston.

6. The resonance oscillator defined in claim 5 wherein the piston is guided in spaced relationship to the cylinder wall in order to provide the connection between the resonance container and the equalizing container.

7. The resonance oscillator defined in claim 5 wherein the piston has a chamber on its front face, said chamber being sealed with respect to the resonance counter by a covering foil.

8. The resonance oscillator defined in claim 7 wherein the covering foil is a metallic foil of titanium.

9. The resonance oscillator defined in claim 5 wherein the active oscillator part in the form of a compound oscillator consisting of two oscillator disks of pais-electrically active material, the disks having live sides abutting against one another in opposite directions via a common contact.

10. The resonance oscillator defined in claim 5 wherein the cylinder accommodating the piston has a bore hole in a region of a base thereof, said bore hole being provided with a packing sleeve, a piston rod of said piston passing through said bore hole.

11. The resonance oscillator defined in claim 5 wherein a unit consisting of the piston, the cylinder and the passive oscillator part is mounted in a housing which is sealed with respect to the outside, and that the active oscillator part together with the abutting covering disk is suspended so that it is damped with respect to the housing in order to suppress vibration transmission.

12. The resonance oscillator defined in claim 11 wherein a first decoupling groove is formed between the housing and the unit consisting of the piston, the cylinder and the passive oscillator part.

13. The resonance oscillator defined in claim 12 wherein the active oscillator part is held in fixed abutment against a covering disk by means of an electrically conductive holding disk over negative sides of the two oscillator disks, the holding disk having a diameter being larger than the diameter of the active oscillator part, the cylinder being provided with a flange of a diameter greater than an outside diameter of the cylinder and corresponding to the diameter of the holding disk, and the flange of the cylinder together with an abutting rim of the holding disk being fixedly connected to the housing.

14. The resonance oscillator defined in claim 13 wherein the flange of the cylinder and the rim of the holding disk are penetrated by a plurality of screw bolts passing through bore holes in the region of the rim of the covering disk.

15. The resonance oscillator defined in claim 13 wherein, apart from the first decoupling groove between the covering disk and the rim, a second decoupling groove is formed between the holding disk and a rim of the holding disk through which screw bolts penetrate.

16. The resonance oscillator defined in claim 13 wherein said piston has a piston rod coupled to a drive mechanism mounted in a space between the cylinder and a housing, said drive mechanism being connected with an electronic system in the space.

* * * * *